United States Patent [19]

Koppe et al.

[11] 3,992,776

[45] Nov. 23, 1976

[54] SHEATH FOR A KNIFE HAVING A HANDLE AND A FIXED BLADE

[76] Inventors: Rudolf Koppe, 27 Kenninghall Blvd., Streetsville, Ontario, Canada; Sigfried Rosenkaimer, Erholungsstrasse 5-7, 565 Solingen-Merscheid, Germany

[22] Filed: Oct. 20, 1975

[21] Appl. No.: 623,961

Related U.S. Application Data

[63] Continuation-in-part of Ser. No. 570,179, April 21, 1975, abandoned.

[52] U.S. Cl. ..... 30/151; 224/2 D

[51] Int. Cl.[2] ..... B26B 29/02

[58] Field of Search ..... 30/151, 162, 296 A; 224/2 R, 2 D, 26 R, 5 D

[56] References Cited

UNITED STATES PATENTS

| | | | |
|---|---|---|---|
| 562,454 | 6/1896 | Browne | 24/11 CT |
| 2,262,340 | 11/1941 | Shalko | 224/26 R |
| 2,768,775 | 10/1956 | Houser | 224/5 D |
| 2,783,536 | 3/1957 | McQueary | 30/151 |
| 2,903,171 | 9/1959 | Rutledge | 224/2 D |
| 3,191,825 | 6/1965 | Beckwith | 224/2 D |

FOREIGN PATENTS OR APPLICATIONS

| | | | |
|---|---|---|---|
| 107,863 | 11/1927 | Austria | 224/2 D |
| 324,361 | 8/1920 | Germany | 224/2 D |

*Primary Examiner*—Al Lawrence Smith
*Assistant Examiner*—J. C. Peters

[57] ABSTRACT

This invention relates to a sheath for a knife having a handle and a fixed blade, the sheath being provided with a spring metal band which includes a resiliently displaceable arched portion extending downwardly into the sheath pocket to bear against the flat surface of the knife blade, the arched portion being supported from an intermediate portion snugly registered within a slot located in one of the sheath walls and anchored therein by a portion extending exteriorily of said sheath and at an angle to the intermediate portion, the anchor portion carrying a clip for securing the sheath to a support and the handle for the knife having a shoulder formation with a shaping corresponding to and complementary with the shaping of the upper edges of the sheath pocket for snug registration therein.

10 Claims, 7 Drawing Figures

SHEATH FOR A KNIFE HAVING A HANDLE AND A FIXED BLADE

This application is a continuation-in-part of our copending application, Ser. No. 570,179, filed Apr. 21, 1975, now abandoned.

THE FIELD OF INVENTION

This invention relates to improvements in a sheath or scabbard for a knife having a handle and a fixed blade and to the combination of such sheath and knife which may be carried in close contact with the body which has been disclosed in part in our prior United States application, Ser. No. 570,179 filed Apr. 21, 1975, now abandoned.

THE BACKGROUND TO THE INVENTION

Knives used for fishing or hunting such as in the filleting of fish or in the skinning of animals mush be kept very sharp if they are to serve their purpose effectively. A sheath or a scabbard usually is provided to preserve the sharpness and to guard against accidental injury.

Such sheaths may take the form of leather pouches made from parts that are either sewn or stapled together and provided with clips and other fittings which are cumbersome and costly.

THE OBJECTS OF THE INVENTION

One object of this invention is to provide an improved sheath for the fixed blade of a knife that will preserve the cutting edge of the blade and hold the knife securely within the sheath against accidental dislodgement.

It is also important to ensure, notwithstanding the relatively secure manner of holding the knife against accidental dislodgement, that the knife be readily removable from the sheath for use and as easily restored within the sheath when no longer required, without substantial risk of impairment to the knife edge.

Still another important object is to provide a sheath that may be readily securely supported from wearing apparel such as from a belt or from the waist of a bathing suit or trousers or from the top of a boot and in a manner presenting the knife handle in ready position for grasping by the hand.

As well it is an important object to provide a combination sheath and knife which may be closely supported against the body.

Still another object is to provide a knife and sheath of relatively light weight and durable construction substantially impervious, for practical purposes, to deterioration through immersion in salt water particularly, and of a quality to present a keen knife edge for the blade all at reasonable cost.

THE FEATURES OF THE INVENTION

One feature of this invention resides in providing in a sheath for a knife, a pair of opposed elongated side walls of substantially opposite symmetry joined along their side and bottom edges to define a pocket open at the top for the registration therewithin of a suitable knife blade, the side walls having an inherent stiffness and resiliency and one side wall having an aperture therethrough in a region spaced below the open top and having a configuration so as to receive in snug registration therewithin an intermediate portion of a spring metal band and so arranged as to support the spring metal band so that its width dimension extends substantially transversely of the elongated supporting side wall, the spring metal band including a resiliently displaceable arched portion located interiorly of said pocket formation and arranged at an angle to the intermediate portion to extend downwardly and present the convex side of same towards the other one of the side walls in order to frictionally resiliently bear against one flat surface of the knife blade, the metal band including an anchor portion located exteriorily of the pocket and arranged at an angle to the intermediate portion so as to substantially secure the intermediate portion of the metal band within the aperture against dislodgement.

Still another feature resides in providing the tip of the resiliently displaceable arched portion remote from the intermediate portion with a configuration adapted to slidingly engage against the inner surface of the supporting sheath wall in order to facilitate the displacement longitudinally of the pocket under the forces imparted by the insertion and withdrawal of the knife blade.

Still another feature resides in providing such arched portion with a width dimension only slightly less than the width dimension of the pocket to minimize any tendency of a sharply pointed knife blade to jam in the recess located between the edges of the arched portion and the pocket walls.

Still another feature resides in providing a clip for attaching the sheath to wearing apparel in the form of an upwardly extending loop formation carried by the anchor portion of the spring metal band, the loop formation presenting a downwardly opening recess for releasably clipping the sheath to a suitable support.

More particularly the loop formation is preferably derived from a spring metal band and further the loop formation remote from the anchor portion preferably terminates in a resilient tip having a configuration adapted to bear in a direction to releasably and resiliently close the downwardly opening recess presented by the loop formation to secure the sheath to a support.

Still another feature resides in providing the knife handle with a generally symmetrical configuration about the plane of the knife blade with the handle presenting a shoulder formation located intermediately of the extent of the knife blade to the upper edges of the sheath walls which shoulder formation and upper edges have corresponding and complementary shaping whereby the shoulder formation is received in snug seated registration to stabilize the combination when the knife blade is in full registration within the pocket of the sheath.

These and other objects and features will become apparent upon reading the following description in conjunction with the sheets of drawings in which.

DESCRIPTION OF PREFERRED EMBODIMENTS

Figures 1, 2, 3:
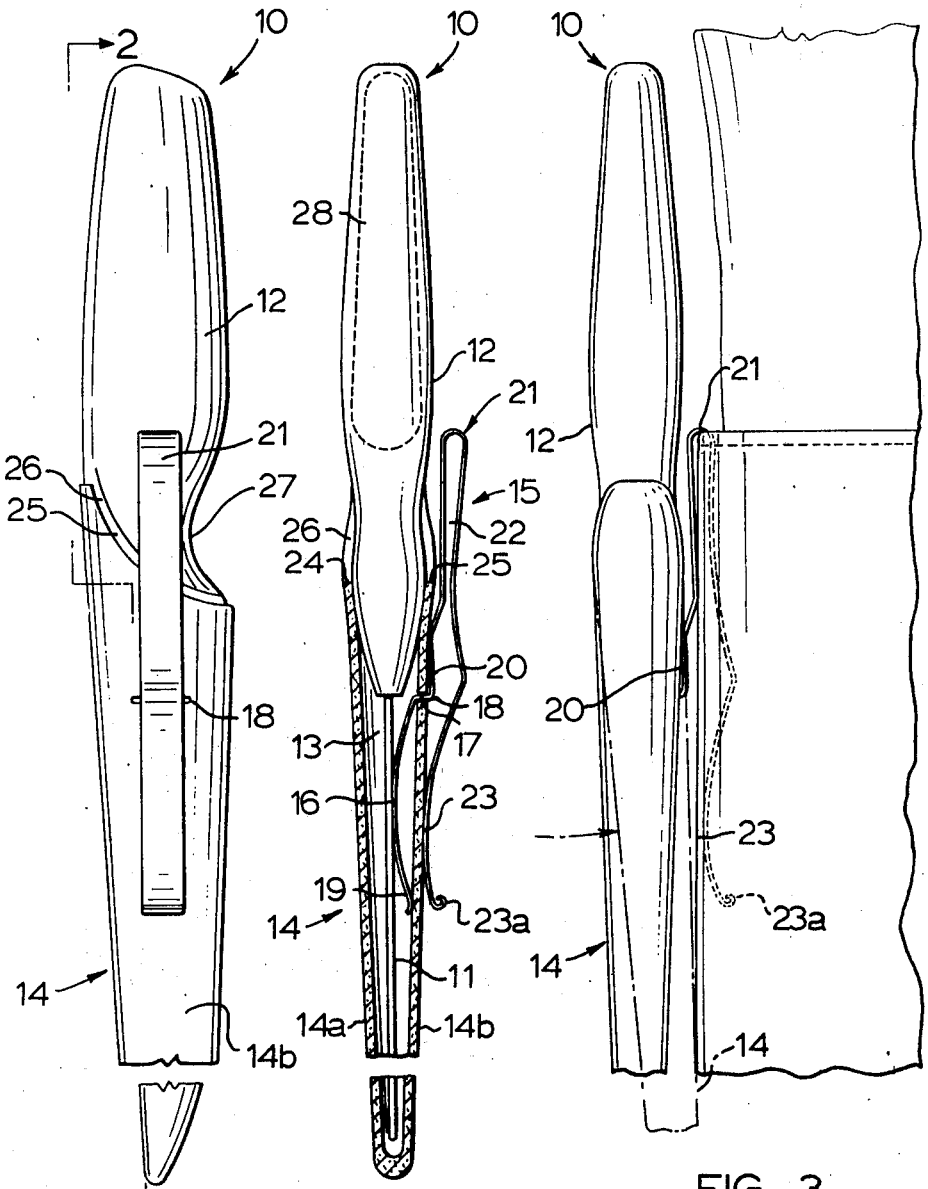
FIG. 1 is a vertical side elevational view of one embodiment of a knife and sheath, with the lowermost portion broken away and revealing the disposition and configuration of the clip attachment for such sheath and knife.
FIG. 2 is a vertical cross-sectional view of that portion of the embodiment illustrated in FIG. 1 taken along the lines 2—2 of FIG. 1 to disclose the manner of anchoring the knife blade by the resilient arched spring portion mounted within the pocket of such sheath.
FIG. 3 is a view in solid outline of the embodiment of FIG. 1 taken from a point to the left in FIG. 1 illustrating the manner of attachment of the sheath to the top of a boot with the broken outline indicating the final, clasped position.
Figure 4:
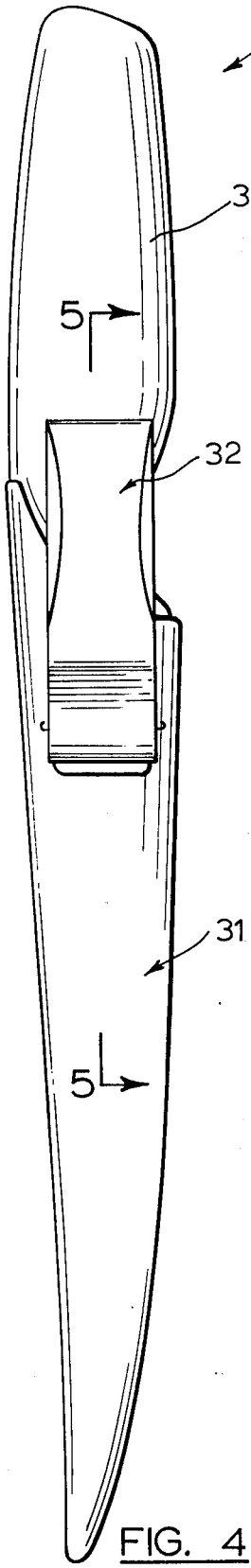
FIG. 4 is a vertical side elevational view of a second embodiment of knife and sheath provided with a modified clip attachment, revealing the relationship of the modified clip attachment to sheath and knife.
Figure 5:
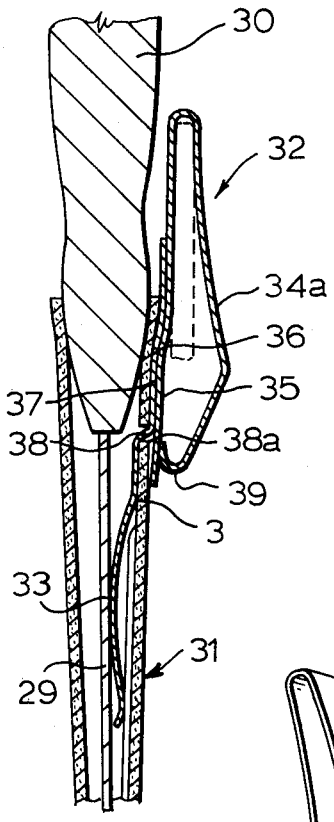
FIG. 5 is a vertical cross-sectional view of that portion of the embodiment illustrated in FIG. 4 partly broken away and taken along the lines 5—5 of FIG. 4 revealing the manner of securing the knife blade within the pocket of such sheath.

The embodiment of the invention illustrated in FIGS. 1 to 3 inclusive reveals a knife 10 provided with a fixed blade 11 anchored within the forward portion of a uniformly contoured handle 12, symmetrical about the plane of the blade with the knife blade shown projecting downwardly into full registration with the pocket 13 of a sheath or scabbard 14.

The opposed sheath walls **14*a* and 14*b*** are of opposite symmetry and preferably to be moulded from polypropylene a durable thermoplastic, relatively stiff but resilient and which will not materially affect the sharpness of the blade edge upon contact.

Each moulded side wall **14*a* and 14*b* has a perimetral configuration in side elevation closely corresponding to the perimeteral outline of the enclosed knife blade 11**.

Supported from the sheath wall **14*b* to extend downwardly within pocket 13 is a smooth spring metal band 15 preferably derived from suitable stainless steel and permanently resiliently arched as at 16 to present a displaceable bearing surface in frictional engagement to the flat surface of knife blade 11**.

The upper end of the arched portion 16 is supported by an intermediate portion 17 extending in a direction generally transversely of the downward extent of arched portion 16 with intermediate portion 17 registered snugly within a slot or aperture 18 which has a cross-section closely following the cross-section of the spring metal band.

The lower end of the arched portion 16 is formed with a slightly curvative tip 19 to facilitate slight sliding movement of such tip on the inner surface of supporting wall **14*b* when the resilient arched portion 16 is displaced under sliding contact with the knife blade 11 when it is inserted into or withdrawn from pocket 13**.

Intermediate portion 17 of metal band 15 joins arched portion 16 to an outer anchor portion 20 extending at substantially right angles thereto and then changing direction to define a narrow loop formation 21 defining a downwardly opening recess 22 with the lowermost extent of the loop formation 22 being reversely arched as at 23 against the outer surface of supporting wall **14*b* to thereby resiliently close the opening. The lowermost tip is rounded as 23*a*** to eliminate any catching or tearing.

Upper edges 24 and 25 of opposed sheath walls **14*a* and 14*b* have a generally saddle shape which corresponds with a complementary shoulder formation 26 presented intermediately of the extent of kinfe handle 12 forwardly of the recess 27** for the index finger.

With the shoulder formation 26 firmly registered in the saddle shaped seat formation defined by upper edges 24 and 25 of the sheath walls **14*a* and 14*b* and with the arched portion 16 of the metal band 15 resiliently biased against knife blade 11 when fully inserted within the pocket 13 of sheath 14** a stable interlock of knife and sheath is established.

Further it is preferable to mould the knife handle 12 from polypropylene plastic but in the form of a hollow body to reduce the weight factor with the outline of the void in knife handle 12 shown only in broken outline in FIGS. 1 and 2 at 28.

The embodiment of FIGS. 4 to 7 inclusive reveal a similar knife 28, knife blade 29 and handle 30 and sheath 31 as compared with the embodiment of FIGS. 1 to 3 inclusive.

Figure 6:
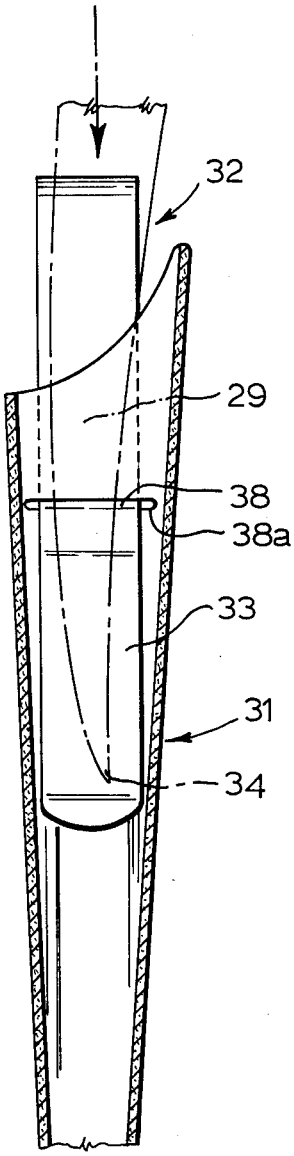
FIG. 6 is a vertical cross-sectional view of the sheath of FIGS. 4 and 5 partly broken away illustrating the manner of supporting the upper end of the resilient arched spring metal band to depend downwardly within such sheath pocket and the passage of the sharpened end of the knife blade into the pocket without jamming.
Figure 7:
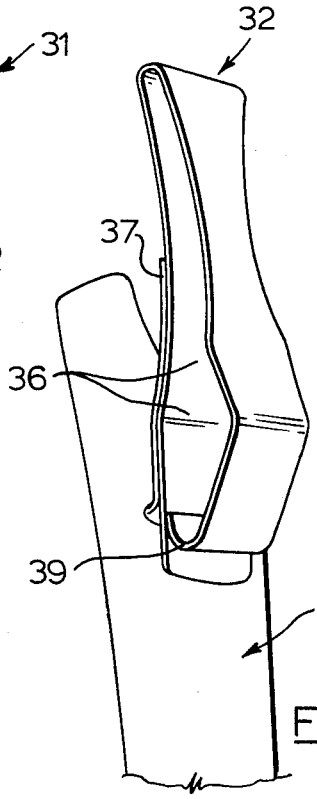
FIG. 7 is a perspective view of the modified clip portion of FIGS. 4 and 5 used for the attachment of such sheath to wearing apparel.

The spring metal band 32 has been modified as compared with the spring metal band 15 of FIGS. 1 to 3 inclusive in the following manner: the width dimension of the arched or convexly shaped portion 33 has been increased so as to eliminate any substantial gap between the edges of the band and the sides of the pocket to avoid possible jamming of the sharp point 34 of knife blade 29 shown in broken outline in FIG. 6. With such combination the knife blade 29 will be readily guided past the resilient arched portion without damage.

According to this embodiment the loop formation **34*a* is formed from a separate piece with the lowermost inner portion 35 being spot welded as at 36 to the upwardly extending anchor portion 37 which includes intermediate portion 38 snugly registered with transverse slot or aperture 38*a***.

Loop formation **34*a* terminates downwardly in an upwardly curvate end 39 which bears against the lowermost innermost portion 35** thereby closing the downwardly opening recess and providng a resilient clip for securing the article to wearing apparel or other support.

The exterior anchor portions 20 and 37 respectively of the spring metal band 21 of FIGS. 1 to 3 inclusive and of the composite spring metal band 32 of FIGS. 4 to 7 inclusive are arranged substantially at right angles to the intermediate portions 17 and 38 so as to bear against the outer surfaces of the sheath walls in the regions above the apertures 18 and **38*a*** respectively.

By reason of such disposition the lower tips of dependent arched portions 16 and 33 are urged under their own tension against the inner surfaces of their respective supporting sheath walls to thereby stabilized the connection.

It will be understood that the spring metal band and knife blade of the embodiments are both preferably derived from suitable stainless steel so as to minimize any corrosive tendency in the presence of salt water.

While the preferred embodiments of the invention have been described and illustrated variations or modifications may be undertaken by those persons skilled in this art without departing from the spirit and scope of the invention as defined in the appended claims.

What I claim is:

1. The combination of a knife having a handle and a fixed blade and a sheath therefor in which said sheath comprises a pair of opposed elongated side walls of substantially opposite symmetry joined along their side and bottom edges to define a pocket open at the top for the snug registration of said knife blade therewithin, said side walls each having an inherent stiffness and resiliency, one said side wall having an aperture therethrough in a region spaced below the open top and having a configuration so as to receive in snug registration therewithin an intermediate portion of a spring metal band and so arranged as to support said spring metal band so that its width dimension extends substantially transversely of said elongated side wall, said spring metal band including a resiliently displaceable arched portion located interiorily of said pocked formation and so arranged at an angle to said intermediate portion as to extend downwardly and present the convex side of same towards the other of said side wall and to frictionally and resiliently bear against one flat surface of said knife blade, said metal band including an anchor portion located exteriorily of said pocket and arranged at an angle to said intermediate portion so as to substantially secure said intermediate portion of said metal band within said aperture against dislodgement, said knife handle having a generally symmetrical configuration about the plane of said knife blade and presenting to the upper edges of said sheath walls defining the open top of said pocket a shoulder formation located intermediately of the extent of said knife handle, said shoulder formation and said upper edges of said side walls having corresponding and complementary shaping whereby said shoulder formation is received in snug seated registration with said upper edges whereby said knife and sheath are releasably interlocked together.

2. A sheath according to claim 1 where said upper edges of said sheath are generally saddle shaped and said shoulder formation has a corresponding and complementary shape.

3. A sheath according to claim 1 wherein said anchor portion of said metal band carries an upwardly extending loop formation presenting a downwardly opening recess for clipping said combined knife and sheath to a suitable support.

4. In a sheath for a knife, a pair of opposed elongated side walls joined along their side and bottom edges to define a pocket open at the top for the registration therewithin of a suitable knife blade, one said side wall having an aperture therethrough in a region spaced below the open top and having a configuration so as to receive in snug registration therewithin an intermediate portion of a spring metal band and so arranged as to support said spring metal band that its width dimension extends substantially transversely of said elongated side wall, said spring metal band including a resiliently displaceable arched portion located interiorily of said pocket formation and so arranged at an angle to said intermediate portion as to extend downwardly and present the convex side of same towards the other said side wall and frictionally resiliently to bear against one flat surface of a knife blade, said metal band including an anchor portion located exteriorily of said pocket, and arranged at an angle to said intermediate portion, so as to substantially secure said intermediate portion of said metal band within said aperture against dislodgement, said anchor portion of said metal band carrying an upwardly extending loop formation presenting a downwardly opening recess for releasably clipping said sheath to a suitable support.

5. A sheath according to claim 4 wherein the tip of said arched portion of said spring metal band remote from said intermediate portion has a configuration adapted to slidingly engage against the inner surface of said supporting sheath wall.

6. A sheath according to claim 4 wherein said loop formation is derived from a resilient spring metal band and wherein said loop formation remote from said anchor portion terminates in a tip having a configuration adapted to bear in a direction to releasably and resiliently close said downwardly opening recess presented by said loop formation.

7. A sheath according to claim 4 wherein said intermediate portion of said spring metal band is arranged at substantially right angles to the extent of said resiliently displaceable arched portion and said anchor portion.

8. A sheath according to claim 4 wherein the width dimension of said arched portion of said spring metal band is slightly less than the width dimension of said pocket in the region wherein said arched portion depends so as to minimize the tendency of a sharply pointed knife blade to jam.

9. A sheath according to claim 6 in which said first mentioned spring metal band and said second mentioned spring metal band are all of a piece.

10. A sheath according to claim 4 in which said pair of opposed elongated side walls are of substantially opposite symmetry each having an inherent stiffness and resiliency.

* * * * *